US006299493B1

(12) United States Patent
Griffith, Sr. et al.

(10) Patent No.: US 6,299,493 B1
(45) Date of Patent: Oct. 9, 2001

(54) STEERING CONTROL METHOD AND APPARATUS FOR DUAL ELECTRIC MOTOR MARINE PROPULSION SYSTEM

(75) Inventors: Thomas E. Griffith, Sr., Florence, MS (US); Loy Hoskins, Springdale; Robert F. Saunders, St. Paul, both of AR (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/539,582

(22) Filed: Mar. 31, 2000

(51) Int. Cl.[7] ..... B63H 19/00
(52) U.S. Cl. ..... 440/6; 114/144 E
(58) Field of Search ..... 440/6, 7; 114/144 E, 114/144 RE, 151

(56) References Cited

U.S. PATENT DOCUMENTS 1,685,350 * 9/1928 Buchet .
3,387,582 * 6/1968 Reeves .
4,311,108 * 1/1982 Horton ..... 114/144 RE
5,057,726 * 10/1991 Mole et al. ..... 310/67 R
5,090,929 * 2/1992 Rieben ..... 440/40
5,131,875 * 7/1992 Lee ..... 440/7
5,401,195 * 3/1995 Yocom ..... 440/6
6,132,267 * 10/2000 Campbell ..... 440/6

* cited by examiner

*Primary Examiner*—Sherman Basinger
(74) *Attorney, Agent, or Firm*—Fletcher, Yoder & Van Someren

(57) ABSTRACT

A technique for steering a watercraft includes applying drive signals to first and second electric propulsion systems disposed at locations on either side of a longitudinal centerline of the craft. The drive signals power motors of the systems to drive props at corresponding speeds and directions. The props generated components of thrust which combine to provide a net resultant thrust to steer the watercraft. An operator command device receives operator commands, and a control circuit translates the commands to the drive signals to steer the craft in accordance with the operator commands.

41 Claims, 7 Drawing Sheets

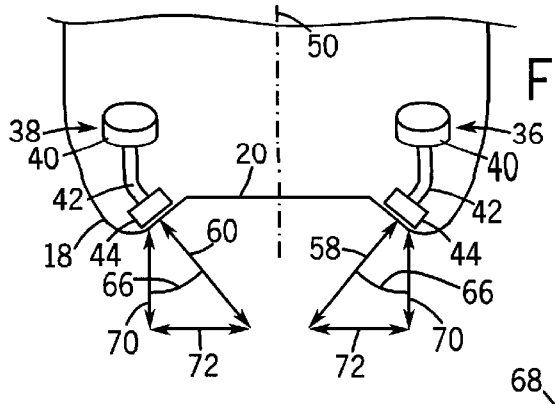
FIG. 3
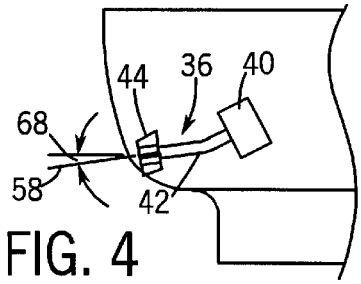
FIG. 4
FIG. 5
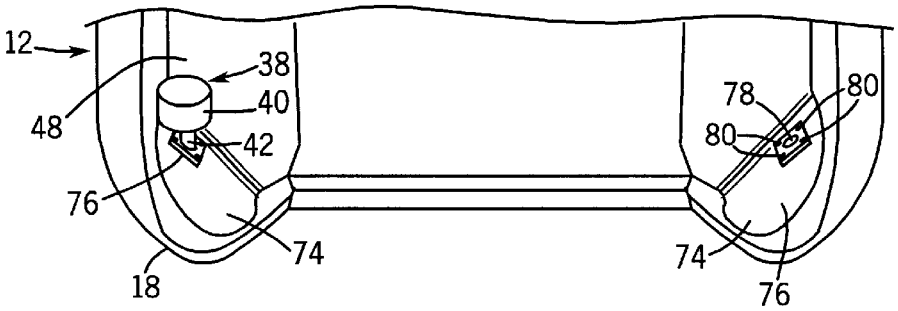
FIG. 6
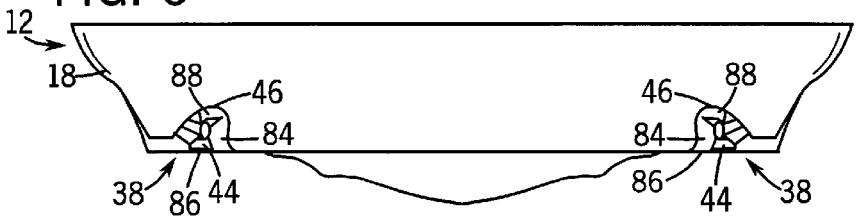
FIG. 7
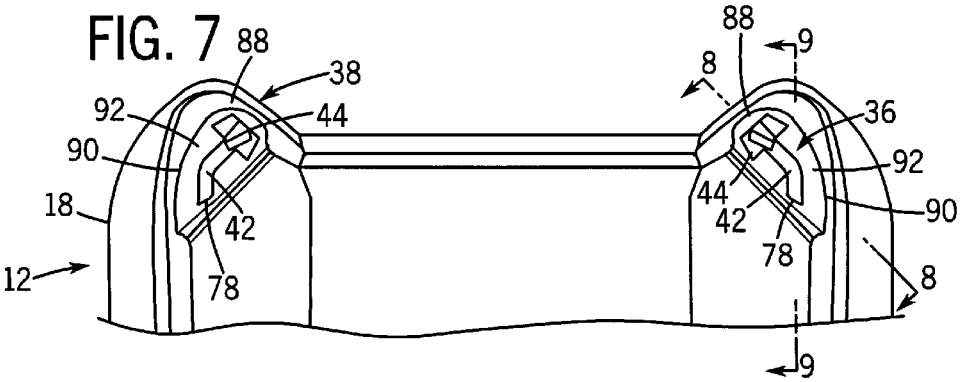

FIG. 8
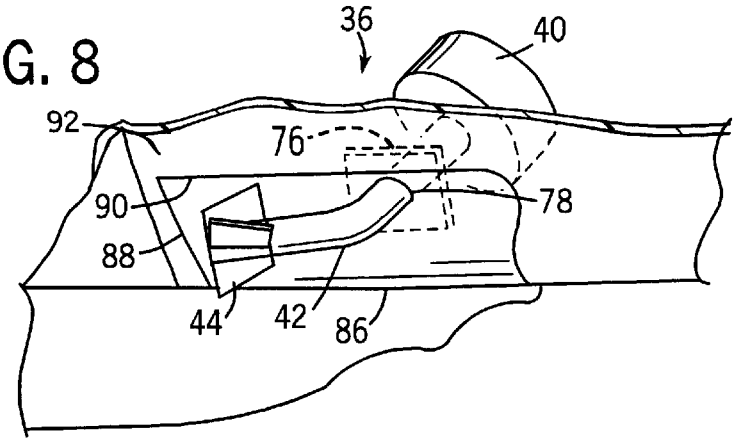
FIG. 9
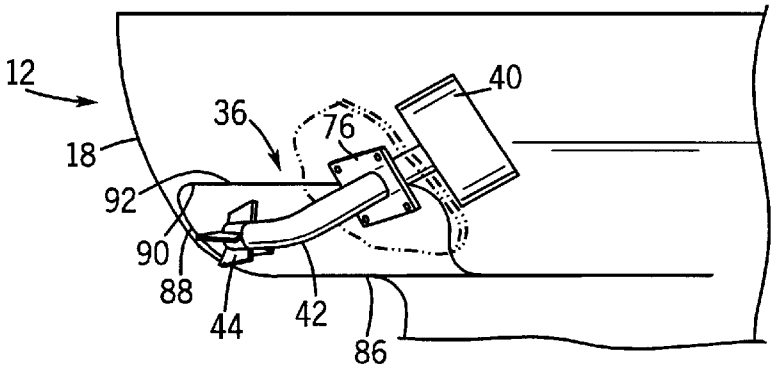
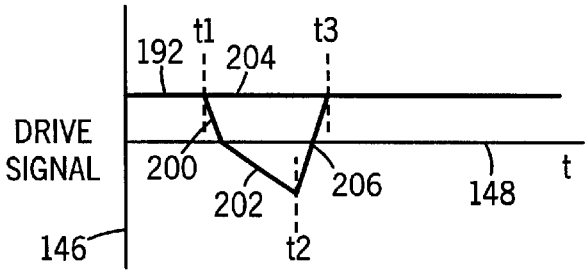
FIG. 17
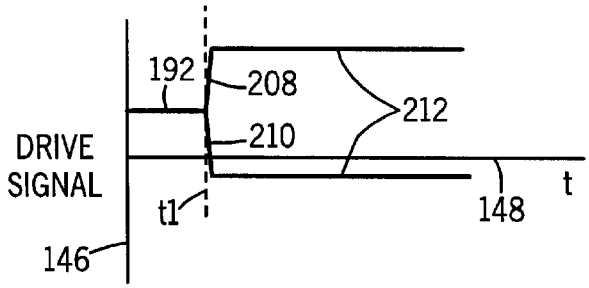
FIG. 18

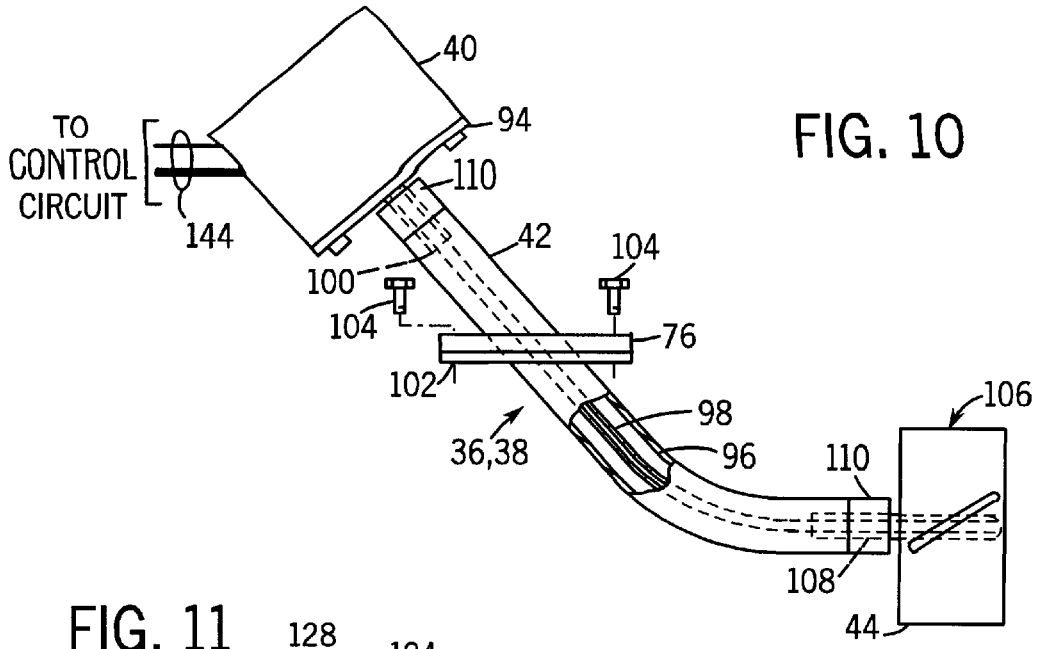
FIG. 10
FIG. 11
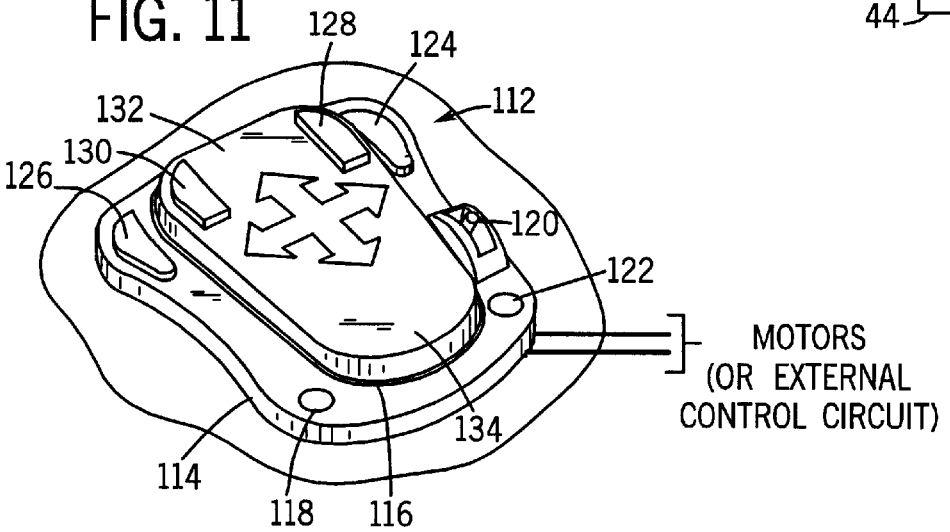
FIG. 13
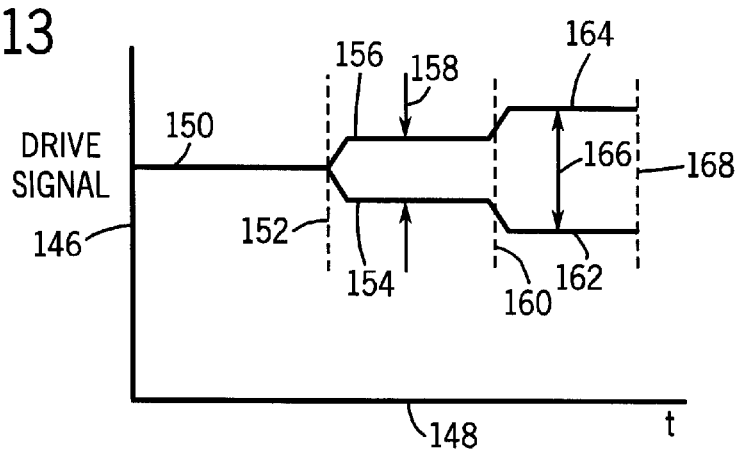

36,38
40
94
96
106
76
42
107
36,38
40
96
110
101
76
42
107
110
108
109
106

FIG. 14
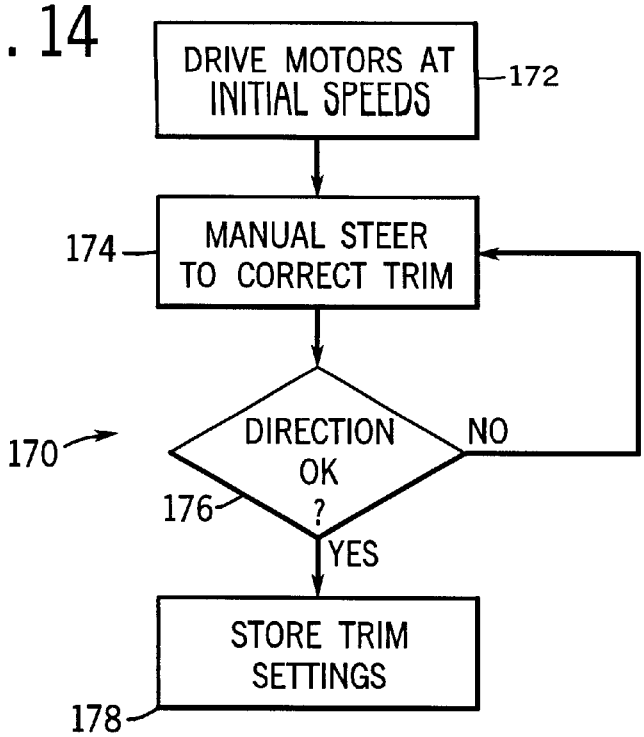
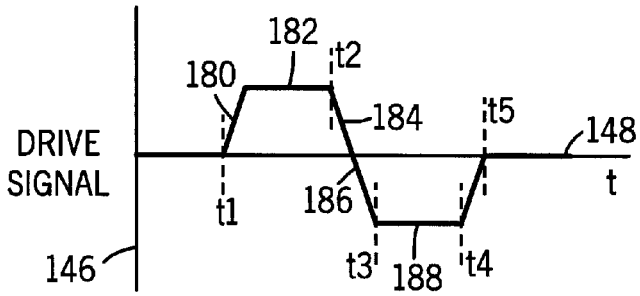
FIG. 15
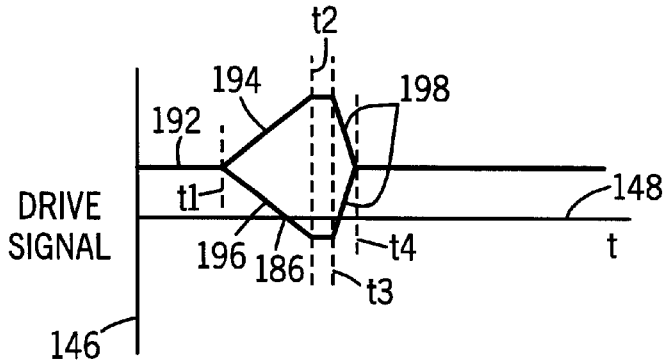
FIG. 16

STEERING CONTROL METHOD AND APPARATUS FOR DUAL ELECTRIC MOTOR MARINE PROPULSION SYSTEM

BACKGROUND OF THE INVENTION

1. Field of the Invention

The present invention relates generally to the field of propulsion systems for watercraft, such as pleasure craft, fishing boats, pontoon boats, ski boats, and so forth. More particularly, the invention relates to a technique for trimming a propulsion system which includes a pair of electric motor-driven props operated in coordination to provide a desired resultant thrust.

2. Description of the Related Art

Various propulsion systems have been proposed and are currently in use for watercraft, such as pleasure craft and fishing boats. Such propulsion systems may typically be classified as either internal engine-based systems, or electric motor-based systems. In the first class, an internal combustion engine is operatively connected to a prop to produce a thrust used to propel the boat through the water. Systems of this type include conventional outboard motors, inboard motors, and the like.

Electric drives, commonly referred to as trolling motors or electric outboards, typically include an electric motor which is energized to rotate at various speeds to drive a prop. In a conventional configuration, the electric motor and prop are provided in a propulsion unit which is submerged when the motor is deployed. Directional orientation of the propulsion unit, through a manually or remotely positionable support tube, determines the direct of the resultant trust and thereby the direction of navigation of the boat.

While propulsion systems of the foregoing types are suitable for many applications, they are not without drawbacks. By way of example, internal combustion engines are simply inappropriate for certain activities, such as fishing, due to their noise and thrust levels. Trolling motors and electric outboards offer quiet and controllable navigational devices, but also have fairly limited controllability, particularly directionally due to the need to rotate the devices during use. The conventional trolling motors are also subject to damage upon contact with submerged objects, and may become entangled in weeds and plant growth as the boat is displaced in shallow waters.

A novel propulsion system has been proposed that includes a pair of propulsion units spaced from one another and secured to a boat hull. The propulsion units each include a variable speed electric motor and a prop rotated by the motor during operation. By coordinating the rotational speeds of the motors, components of a desired resultant thrust may be generated by the units to navigate the boat in various directions. The system offers considerable advantages over heretofore known propulsion systems, including inherent controllability, lower maintenance and deployment times, inherent protection from submerged objects, and so forth.

A challenge in the control of the new propulsion system resides in the appropriate coordination of the rotational speeds of the motors, both over forward and reverse speed ranges. There is a need, therefore, for a technique designed to control such a system. There is a particular need for a technique which is both intuitive and relatively straightforward to implement.

SUMMARY OF THE INVENTION

The invention provides a technique for controlling the steering in a dual electric motor propulsion drive designed to respond to these needs. The control system offers an intuitive interface for operator control, and may be based upon a foot pedal control offering a wide range of navigational freedom. A control unit, which may be positioned within such an input device, offers coordinated control of the electric motors of the propulsion units. The electric motors are thus driven at a range of speeds to produce the desired resultant thrust from the propulsion unit props. As the operator steers the craft, the props are driven at higher or lower speeds to adjust the resultant thrust. In a present embodiment, the electric motors of the propulsion units are bi-directional and the control system is adapted to coordinate the components of thrust in both directions. Accurate speed control and directional navigation are thus provided in a straightforward manner.

BRIEF DESCRIPTION OF THE DRAWINGS

The foregoing and other advantages of the invention will become apparent upon reading the following detailed description and upon reference to the drawings in which:

FIG. 3 is a diagrammatical representation of the stern region of the watercraft of FIG. 2 illustrating components of thrust produced by the propulsion units;

FIG. 4 is a diagrammatical side view of one of the units shown in FIG. 3 illustrating an exemplary vertical offset;

FIG. 5 is a top plan view of the stern region of the watercraft illustrated in the previous figures, showing the placement of the propulsion units within cavities formed within the hull;

FIG. 6 is a rear elevational view of the stern region shown in FIG. 5 with the propulsion units in place, illustrating a manner in which the props may be lodged within recesses formed in the hull;

FIG. 7 is a bottom plan view of the stern region shown in FIG. 5 illustrating the placement of the propulsion unit props within recesses of the hull;

FIG. 8 is a partial sectional view along line 8—8 of FIG. 7 illustrating the position of one of the propulsion units within the recess formed in the hull;

FIG. 9 is a partial sectional view along line 9—9 of FIG. 7, again illustrating the placement of one of the propulsion units within the hull;

FIG. 10 is a plan view of one of the propulsion units illustrated in the previous figures, removed from the hull for explanatory purposes;

FIG. 11 is a perspective view of a control unit, in the form of a foot pedal control, for inputting operator commands used to navigate the watercraft by powering the propulsion units illustrated in the foregoing figures;

FIG. 13 is a graphical representation of drive signals applied to the propulsion units illustrated in the foregoing figures during a trim adjustment procedure;

FIG. 14 is a flow chart illustrating exemplary steps in a trim procedure for adjusting thrust or speed offsets between propulsion units of the type illustrated in the foregoing figures;

FIG. 15 is a graphical representation of drive signals for a propulsion system of the type illustrated in the foregoing figures; and, FIGS. 16–18 are graphical representations of exemplary drive signal relationships used to navigate a watercraft through control of propulsion units as illustrated in the foregoing figures.

DETAILED DESCRIPTION OF SPECIFIC EMBODIMENTS

Figure 1:
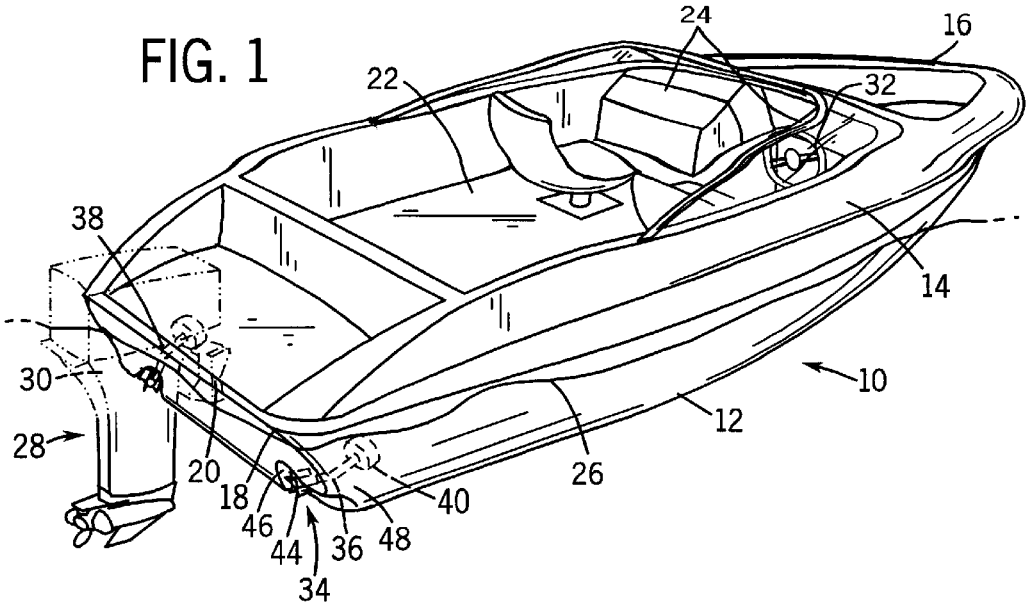
FIG. 1 is a perspective view of a watercraft incorporating certain features in accordance with the present technique.

Turning now to the drawings and referring first to FIG. 1, a watercraft 10 is illustrated that includes various features in accordance with the present technique. While the present technique is not necessarily limited to any particular type of craft, it is particularly well suited to smaller pleasure craft, such as fishing boats, ski boats, pontoon boats, and so forth. In the embodiment illustrated in FIG. 1, the watercraft 10 has a single hull 12 on which a deck 14 is fitted. The hull and deck may be formed as separate components and later assembled along with the other elements needed to complete the watercraft. The watercraft then presents a bow 16 and a stern 18, with a transom 20 being provided in the stern region for supporting various components as described below. A cabin 22 may be formed in the deck section 14, and an operator's console 24 allows for control of the watercraft, such as for navigating to and about desired areas in a lake, river, offshore area or other body of water. When floated on a body of water, the watercraft generally has a waterline 26 below which the propulsion devices described below are positioned In the embodiment illustrated in FIG. 1, a primary propulsion system, designated generally by reference numeral 28, includes a conventional outboard motor 30 secured to transom 20. Alternatively, more than one such outboard may be provided, or an inboard motor may be provided partially within the watercraft hull. As will be appreciated by those skilled in the art, such outboard motors and inboard motors typically include an internal combustion engine for driving a prop. Navigation of the system is controlled by adjustment of a rudder or of the annular position of the outboard 30, such as by means of a steering wheel 32.

Also as shown in FIG. 1, a secondary propulsion system 34 is provided in the stern region 18. In the illustrated embodiment, the secondary propulsion system 34 includes first and second propulsion units 36 and 38. Each propulsion unit is provided in the stern region on either side of the outboard motor 30. As described more fully below, each propulsion unit 36 and 38 includes an electric motor 40 positioned within the hull, a support and power transmission assembly 42 (see, e.g., FIG. 10), extending from the electric motor to an outboard surface of the hull, and a prop 44 positioned outside the hull and driven by the electric motor. Also as described more fully below, the prop 44 of each propulsion unit is preferably positioned within a recess 46 formed integrally within the hull. The electric motors, then, are positioned within one or more inner cavities 48 formed by the hull and generally included between the hull section of the watercraft and the deck 14. The motors may be enclosed within compartments, and accessed via doors or hatches in the deck (not shown). It should be noted that switched reluctance motors may also be utilized within the propulsion units.

While in the present embodiment the preferred positions of the propulsion units are in the stern region, it should be noted that other positions may be provided in accordance with certain aspects of the present technique. For example, the propulsion units may be positioned adjacent to lateral sections of the hull, to produce components of thrust directed laterally and in fore-and-aft directions.

Figure 2:
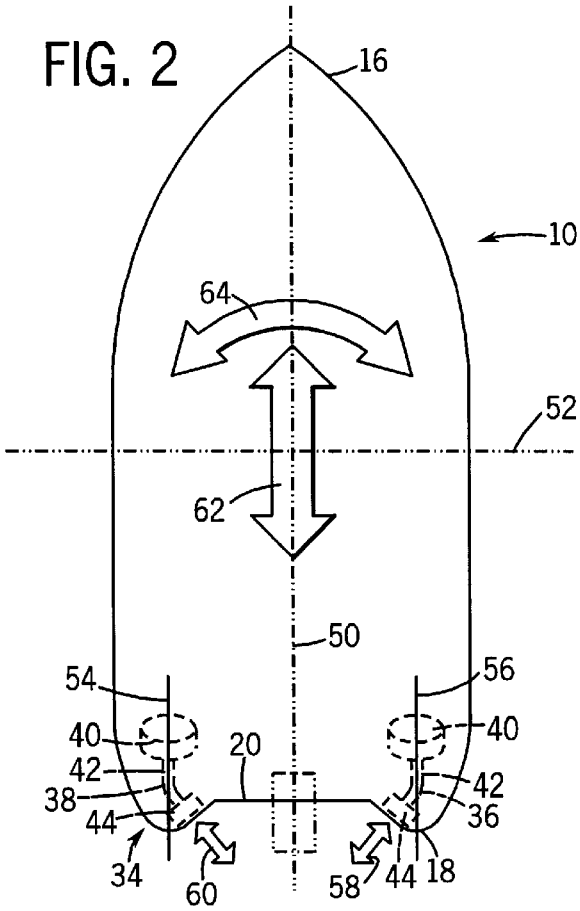
FIG. 2 is diagrammatical plan view of the watercraft of FIG. 1 illustrating the layout of propulsion system comprising electric motor drives positioned in a stern region of a hull.

In the diagrammatical representation of FIG. 2, the propulsion units 36 and 38 are shown in their positions in accordance with a present embodiment. As will be appreciated by those skilled in the art, watercraft 10 generally presents a longitudinal centerline 50 and a transverse centerline 52 orthogonal to longitudinal centerline 50. The propulsion units are positioned at locations 54 and 56 which are symmetrical with respect to longitudinal centerline 50. In the illustrated embodiment, each of the propulsion units is oriented so as to produce a thrust which is directed both in a fore-and-aft orientation, as well as in a direction oblique with respect to the longitudinal centerline 50. In the present embodiment, the thrust, as generally represented by arrows 58 and 60, may be created in either direction so as to propel the watercraft forward (in the direction of the bow) or reverse (in the direction of the aft) and to turn the watercraft as desired. Thus, in the diagram of FIG. 2, a resultant thrust 62 may be said to be available generally along longitudinal centerline 50, with this thrust being oriented at various angles, as represented by reference numeral 64, by relative control of the propulsion units.

The components of the thrust produced by the propulsion units are illustrated diagrammatically in somewhat greater detail in FIGS. 3 and 4. As shown in FIG. 3, the propulsion units 36 and 38 are positioned in the stern region and the props are oriented so as to produce the thrust 58 and 60 at oblique angles with respect to the centerline 50. In a present embodiment, the angle of the thrust produced with respect to the centerline, as represented by reference numeral 66 in FIG. 3, is approximately 45°. As will be appreciated by those skilled in the art, however, other angles may be employed and the relative speeds of the propulsion units, as described below, controlled appropriately to produce a resultant thrust to navigate the watercraft. In addition to the offset angle with respect to centerline 50, the propulsion units may be disposed so as to produce a thrust which is offset with respect to a horizontal plane, as illustrated in FIG. 4. The angle 68, generally inclined downwardly in an aft direction with respect to a horizontal plane, is approximately 8° in a present embodiment.

Referring again to FIG. 3, as the propulsion units are driven at desired speeds as described below, the thrust 58 and 60 produced by the units may be resolved into two orthogonal components of thrust as indicated by reference numerals 70 and 72. More particularly, a first component 70 of the thrust is generally oriented parallel to centerline 50, to propel the watercraft in the forward or reverse direction. The orthogonal component 72 of the thrust serves to orient the watercraft angularly, such as to turn the watercraft when being displaced forward or reverse, or with no or substantially no forward or reverse displacement at all.

The propulsion units in the illustrated embodiment may be conveniently mounted within the stern region of the watercraft, being secured to a wall section of the hull shell, as illustrated in FIGS. 5–9. More particularly, the electric motor 40 of each propulsion unit, which is coupled to a control unit to receive drive signals as described below, is mounted within the inner cavity 48 formed within the hull, and may be conveniently supported on the support and power transmission assembly 42. In the illustrated embodiment, a relatively planar section 74 of the hull shell is designed to receive a mounting plate 76 (see, e.g., FIG. 8) which is fixed to the support and power transmission assembly 42, and generally forms a part thereof. In FIG. 5, the right propulsion unit has been removed to illustrate an exemplary configuration of wall section 74 for receiving and supporting the propulsion unit. In this exemplary embodiment, an aperture 78 is formed through the hull shell wall and extends from the inner cavity to the surface defining recess 46 (see, e.g., FIG. 6). Additional apertures 80 may be provided around aperture 78 for receiving fasteners used to secure the mounting plate to the hull.

While the foregoing structure of the hull and the position of the propulsion units are desired, it should be appreciated that the addition of the propulsion units to the watercraft may be an optional feature available at or after initial sale or configuration of the craft. For example, where a user does not desire the secondary propulsion system including the propulsion units positioned within the recesses of the hull, the recesses may nevertheless be formed in the hull to accommodate the propulsion units which may then be added to the watercraft such as in the form of kits without substantial reworking of the hull. In such case, the apertures 78 and 80 may simply be covered by sealing plates or similar assemblies, generally similar or identical to mounting plate 76, which are left in place until the propulsion units are mounted. The recesses 46 formed in the hull will not adversely affect the performance of the hull, even when the propulsion units are not mounted as illustrated. Alternatively, a cap or plate could be placed over the recesses to partially or completely cover the recesses, where desired.

As shown in FIG. 6, each propulsion unit is preferably mounted in the hull such that the prop 44 is substantially or completely protected by the bounds of the recess. Each recess is therefore defined by an inner wall 84 which forms part of the outboard wall or surface of the hull shell. In the illustrated embodiment, the recesses have an open bottom 86 and an open aft region 88 such that water may be displaced through the recess by rotation of the prop. It may also be noted in FIG. 6 that, when placed in use, the uppermost limits of each recess preferably lie below waterline 26.

The shape, orientation and contours of the recesses are preferably designed to promote desired water flow to and from the props of the propulsion units. In the partial bottom plan view of FIG. 7, each recess is illustrated as including, in addition to the open aft region 88 and open bottom 86, an upper or top surface 90. The top surface 90 may be substantially planar, such as forming a part of the wall through which the propulsion units extend and to which the propulsion units are securely mounted, facilitating mounting and sealing. Moreover, a section of the upper or top surface 90 preferably forms an integral cavitation plate 92. As will be appreciated by those skilled in the art, such a cavitation plate serves a general purpose of maintaining water flow over the props during use, so as to prevent or reduce the entrainment of air through the recess, or the creation of air bubbles due to localized low pressure regions formed by rotation of the props. In general, the integral cavitation plates 92 may be angularly oriented downwardly in a fore-to-aft direction so as to direct water in a steady and smooth stream generally oriented in the same direction as the props themselves.

FIGS. 8 and 9 represent somewhat simplified sections through one of the recesses shown in FIG. 7. Again, the support and power transmission assembly 42 of the propulsion unit extends through aperture 78 to position the prop 44 within the recess. The recess then guides water displaced by the prop, guiding the flow of water by the surfaces of the recess between the open bottom region 86 and the open aft region 88. The top surface of the recess then forms the cavitation plate which reduces entrainment of air and bubbling of the water during operation.

FIG. 10 illustrates a present embodiment for each propulsion unit 36 and 38. In the illustrated embodiment, the propulsion units include a motor 40 coupled to drive the prop 44 through the intermediary of the support and transmission assembly 42. While any suitable motor may be employed, in the present embodiment, a switched reluctance motor is used by virtue of its high efficiency, relatively small size and weight, variable speed controllability, reversibility, and so forth. The motor is coupled to a control circuit via a network bus 144 as described in greater detail below. The motor is supported on a motor support bracket or plate 94 which may be fixed to the support and power transmission assembly 42.

The support and power transmission assembly 42 both provides support for the motor and prop, and accommodates transmission of torque from the motor to the prop. In the illustrated embodiment, assembly 42 includes a support tube 96 made of a rigid tubular material, such as stainless steel. Within tube 96 a flex shaft assembly 98 is provided, extending from motor 40 to prop 44. As will be appreciated by those skilled in the art, such flex shaft assemblies generally include a flexible sheath in which a flexible drive shaft is disposed coaxially. The sheath is held stationary within the support tube, while the flexible shaft is drivingly coupled to a drive shaft 100 of motor 40. Mounting plate 76 may be rigidly fixed to support tube 96, such as by welding. This connection of the plate to the support tube provides for the necessary mechanical support, as well as a sealed passage of the support tube through the support plate. A seal or gasket 102 is provided over the support plate to seal against the hull shell when the propulsion unit is installed. Fasteners 104 permit the seal 102 and support plate to be rigidly fixed to the watercraft hull. As will be appreciated by those skilled in the art, while in the illustrated embodiment the support plate and the gasket are provided on an inner surface of the hull, a similar support plate and gasket may be provided on the outer surface of the hull, or plates and gaskets may be provided on both the inner and outer surfaces of the hull.

The prop assembly 106 is secured at a lower end of support tube 96. In the illustrated embodiment, prop assembly 106 is a freely extending propeller which rotates without a shroud. However, where desired, an additional shroud or various alternative propeller designs may be provided. Prop assembly 106 further includes a driven shaft 108 which is drivingly coupled to the flex shaft assembly 98. Bearing and seal assemblies 110 are provided at either end of the support tube and provide for rotational mounting of the flex shaft assembly and of the motor and prop shafts, and seal the interior of the support tube from water intrusion.

Figures 10A, 10B:
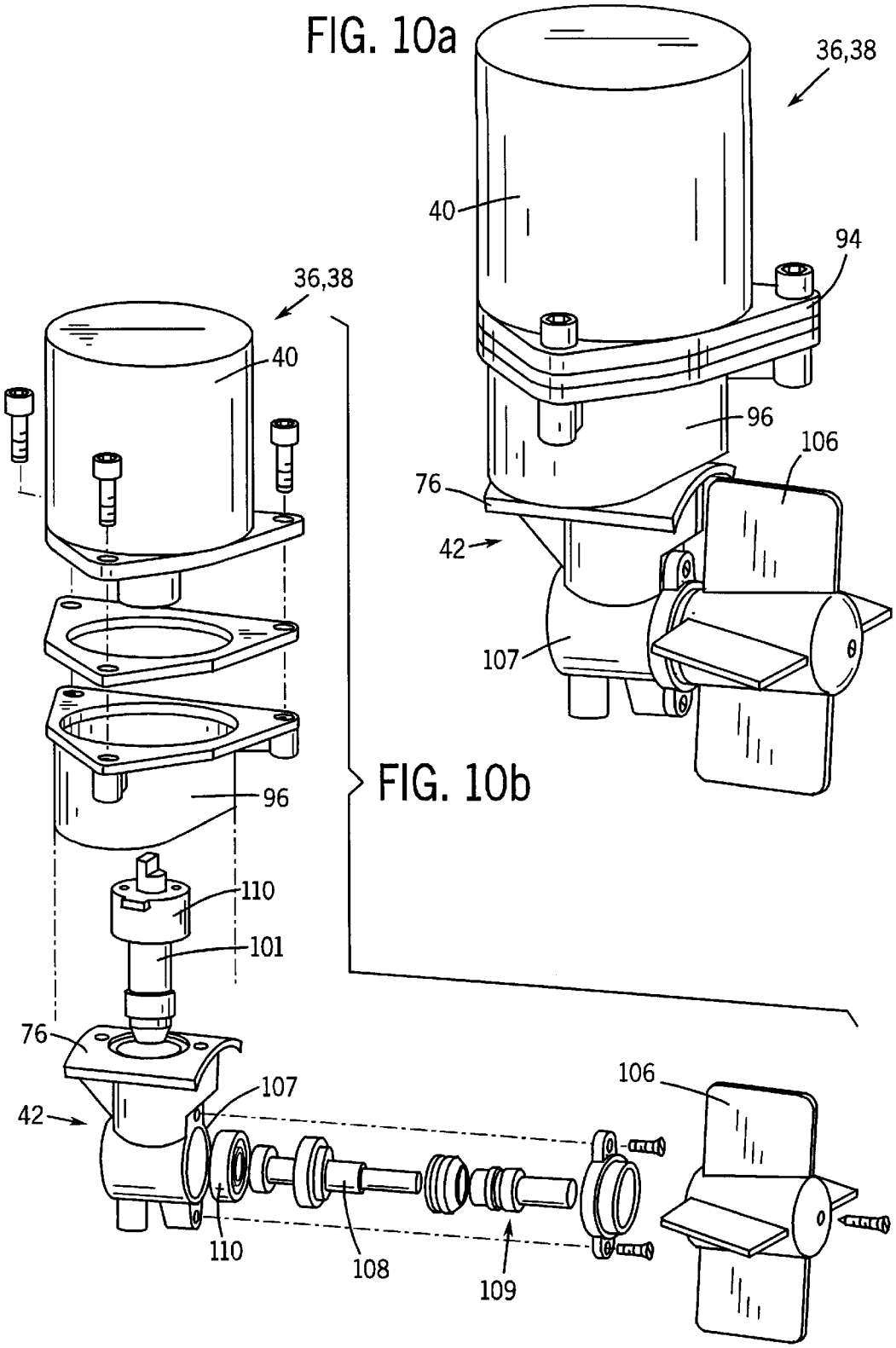
FIGS. 10*a* and 10*b* are perspective and exploded views, respectively, of a preferred embodiment of a propulsion unit for use in the present technique, where a rigid shaft transmission arrangement can be employed.

FIGS. 10*a* and 10*b* represent a second preferred embodiment for the propulsion units 36 and 38 wherein a straight or rigid transmission shaft is employed for transmitting torque. As illustrated in FIG. 10*a,* the propulsion unit includes a motor 40 and support and power transmission assembly 42, with a mounting plate 76 extending therebetween. As described above, mounting plate 76 is provided for facilitating fixation of the propulsion units to the hull and for interposition of a seal between the plate and the hull. Motor 40 is mounted on a motor support 94 which, in turn, is secured to a modified support tube or housing 96. In the illustrated embodiment, a 90° gear transmission 107 provides for translating torque from motor 40 about 90° for driving prop assembly 106.

Referring to the exploded view of FIG. 10*b*, motor 40 is secured to the support tube or housing 96 as illustrated, and a straight or rigid transmission shaft 101 extends between the gear transmission 107 and the motor. Moreover, a driven shaft 108 extends from the gear transmission to drive a sealed propeller shaft assembly 109. In the illustrated embodiment, assembly 109 may include seals, a driven shaft, and a retaining and sealing plate for preventing the intrusion of water into the gear transmission housing. Bearing assemblies 110 support the shafts in rotation within the assembly. The arrangement of FIGS. 10*a* and 10*b* is particularly well suited to placements wherein sufficient space is available for mounting of the electric motor inboard, with the gear transmission positioned outboard. It will be noted that space constraints are substantially reduced by the arrangement, and mounting surfaces and recess sizes may be similarly reduced.

As will be appreciated by those skilled in the art, various modifications may be made to the propulsion units described above. For example, while the motor may be positioned in a completely external propulsion unit along with the prop assembly, in the preferred embodiment illustrated, the electric motor may be preserved in the dry cavity and compartment of the hull, while nevertheless providing the torque required for rotating the prop. Similarly, alternative fixation arrangements may be envisaged, such as plates or support assemblies with brackets which are fixed either to the prop assembly itself, or to various points along the support and power transmission assembly, or directly adjacent to the electric motor.

Control of the propulsion units may be automated in accordance with various control algorithms, but also preferably allows for operator command inputs, such as via a control device as illustrated in FIG. 11. FIG. 11 illustrates an exemplary operator control 112 formed as a base 114 on which a foot control 116 is positioned. While the operator inputs may be made through an operator's console, such as console 24 shown in FIG. 1, the operator control 112 of FIG. 11 provides for hands-free operation, similar to that available in conventional trolling motor and electric outboard systems. However, the operator control 112 of FIG. 11 includes additional features not found in conventional devices.

In the embodiment illustrated in FIG. 11, the operator control 112 includes a series of switches and inputs for regulating operation of the propulsion units 36 and 38. By way of example, an on/off switch 118 is provided for enabling the system. A variable speed set or control input 120 is provided for regulating the relative thrust level or velocity of the propulsion system as described more fully below. Continuous forward and continuous reverse switches 124 and 126 are provided for selecting fixed and continuous forward and reverse operation. Momentary forward and momentary reverse switches 128 and 130 allow the operator to rapidly and temporarily reverse the direction of rotation of the propulsion units. Moreover, foot control 116 may be rocked towards a toe region 132 or toward a heel region 134 to provide a steering input. In a preferred embodiment, the foot control 116 is biased toward a centered position with respect to the steering inputs such that the operator must forcibly depress the foot control towards the toe region or the heel region to obtain the desired left or right steering input. By way of example, depressing the foot control 116 towards toe region 132 produces a "steer right" command, while depressing the heel region 134 produces a "steer left" command.

Figure 12:
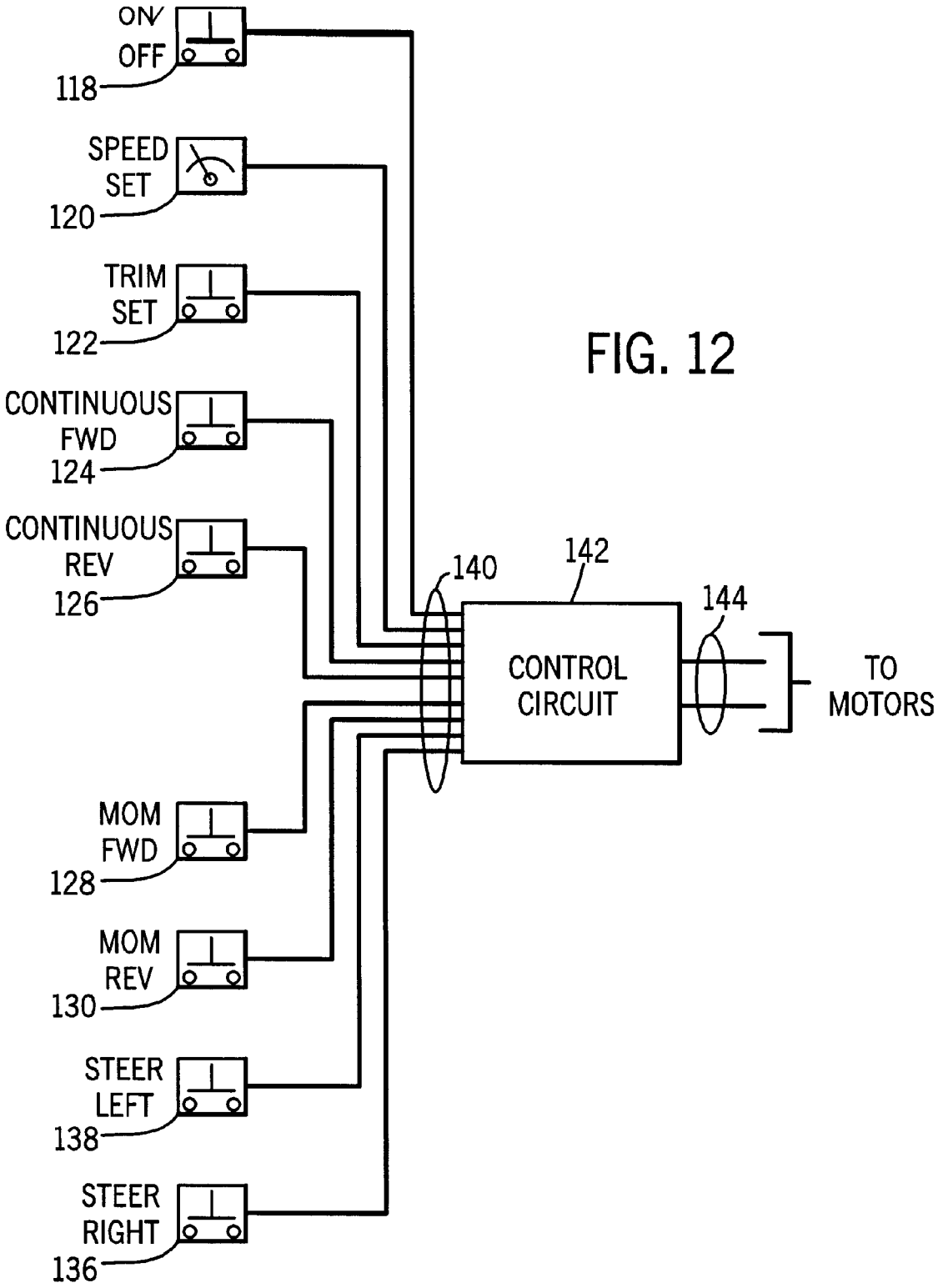
FIG. 12 is a diagrammatical representation of certain of the control input devices associated with the control unit of FIG. 11 in connection with a control circuit for regulating speed and direction of the propulsion units.

FIG. 12 illustrates diagrammatically the arrangement of switches within operator control 112 and the manner in which they are coupled to a control circuit for regulation of the speeds of motors 40 of the propulsion units. In particular, the on/off switch 118 may be selected (e.g., closed) to provide an on or off command to enable or energize the system. Speed setting 120, which may be a momentary contact switch or a potentiometer input, provides a variable input signal for the speed control within a predetermined speed control range. A momentary contact switch 122 provides for setting a trim adjustment or calibration level as described more fully below. The continuous forward and continuous reverse switches 124 and 126 provide signals which place the drive in continuous forward and continuous reverse modes wherein the propulsion units are driven to provide the desired speed set on the speed setting input 120. Momentary forward and momentary reverse switches 128 and 130 are momentary contact switches which cause reversal of the propulsion units from their current direction so long as the switch is depressed. Finally, steer right and steer left switches 136 and 138, provided beneath the toe and heel region 132 and 134 of the operator control are momentary contact switches which provide input signals to alter the relative rotational speeds or settings of the propulsion units, such as depending upon the duration of time they are depressed or closed.

The control inputs illustrated diagrammatically in FIG. 12, are coupled to a control circuit 142 via communications lines 140. The communications lines 140 transmit signals generated by manipulations or settings of the control inputs to the control circuit. In a presently preferred embodiment, control circuit 142 includes a microprocessor controller, associated volatile and non-volatile memory, and signal generation circuitry for outputting drive signals for motors 40. Moreover, while illustrated separately in FIG. 12, control circuit 142 may be physically positioned within the operator control package. Appropriate programming code within control circuit 142 translates the control inputs to determine the appropriate output drive signals. As described more fully below, the drive signals may be produced within a predetermined range of speed settings. Upon receiving speed set commands, forward or reverse continuous drive commands, momentary forward or momentary reverse commands, steer left or steer right commands, control circuit 142 determines a level of output signal (e.g., counts from a preset available speed range) to produce the desired navigation thrust as commanded by the operator. Drive signals for the motors are then conveyed via a network bus 144, such as a control area network (CAN), for driving the motors. By way of example, functional components for use in control circuit 142 may include a standard microprocessor, and motor drive circuitry available from Semifusion Corporation of Morgan Hill, Calif. A CAN bus interface for use in control circuit 142 may be obtained commercially from Microchip Technology, Inc. of Chandler, Ariz.

It should be noted that, while in the foregoing arrangement, control inputs are received through the operator control only, various automated features may also be incorporated in the system. For example, where electronic compasses, global positioning system receivers, depth finders, fish finders, and similar detection or input devices are available, the system may be adapted to produce navigational commands and drive signals to regulate the relative speeds of the propulsion units to maintain navigation through desired way points, within desired depths, in preset directions, and so forth.

While the propulsions units 36 and 38 are generally similar and are mounted in similar positions and configurations, various manufacturing tolerances in the mechanical and electrical systems may result in differences in the thrust produced by the units, even with equal control signal input levels. The propulsion units and the propulsion system are therefore preferably electronically trimmed or calibrated to provide for equal thrust performance over the range of speed and direction settings. FIGS. 13 and 14 illustrate a present manner for carrying out the electronic trim adjustment procedure. In particular, FIG. 13 illustrates graphically a manner in which the drive signals to the motors 40 of the propulsion units 36 and 38 may be sequentially adjusted during the calibration procedure to determine a nominal offset or trim setting. FIG. 14 illustrates exemplary steps in control logic for carrying out this process.

FIG. 13 illustrates drive signals to motors 40 of the propulsion units graphically, with the magnitude of the drive signals being indicated by vertical axis 146 and time being indicated along the horizontal axis 148. In the trim calibration process, designated generally by reference numeral 170 in FIG. 14, once the operator depresses the trim set input 122 (see FIG. 12; a visual or audible indictor may provide feedback of entry into the trim calibration process), an initial speed setting is provided, as shown by trace 150 in FIG. 13, to drive the motors at a preset initial speed, as illustrated at step 172 of FIG. 14. It is contemplated that the calibration should be carried out in a relatively calm body of water with little or no current or wind. Depending upon manufacturing and operating tolerances and variations of the propulsion units, different thrusts may be produced. Such differences in thrust may also result from the inherent torque or moment of the props associated with the propulsion units. These factors may, in practice, cause the watercraft to deviate from a "straight-ahead" setting, veering to the left or to the right. At step 174 in FIG. 14, the operator then manually steers the system, such as by depressing the toe or heel regions of the operator input, to correct for the error in the direction of setting. In graphical terms, as shown in FIG. 13, this manual correction occurs at reference numeral 152, resulting in a decrease in the drive signal level 154 to one of the motors, with an increase in the drive signal level 156 to the other motor. A first offset 158 thus results from the differences in the two drive signal levels. As noted above, where the signals are computed by the control circuitry in terms of counts over a dynamic range, the initial offset 158 may be a relatively small number of counts.

At step 176 of FIG. 14, the operator determines whether the tracking provided by the new setting is sufficient (i.e. steers the watercraft in a straight-ahead direction). If the trim is not sufficiently corrected, an additional manual steering correction may be made, as represented at reference numeral 160 in FIG. 13. This additional correction leads to a further decrease 162 in the drive signal applied to one of the motors, with a corresponding increase 164 in the drive signal applied to the other motor. The offset or correction difference 166 is correspondingly increased. Note that the operator could also decrease the trim difference if the previous steering adjustment overcompensated for the steering error. Once the operator has determined that the system is properly set to guide the watercraft in the desired direction (e.g., straight-ahead), the settings are stored, as indicated at step 178 in FIG. 14, by depressing the trim set input 122 (see FIG. 12). At such time, as shown graphically at reference numeral 168 in FIG. 13, the then-current offset 166 is stored in the memory of the control circuit, such as in the form of a number of counts over the dynamic range of the drive signals. This value is then used in future navigation of the system, to alter the relative speed settings of the propulsion units, providing accurate and repeatable steering based upon known command inputs. As will be appreciated by those skilled in the art, while the offset between the speed settings may be constant and linear (i.e. based upon a linear relationship between the rotational speed and the resultant thrust), the foregoing technique may be further refined by providing for variable or non-linear adjustment (e.g., computing a varying offset depending upon the relative speed settings).

As noted above, components of thrust produced by propulsion units 36 and 38 may be employed to drive the watercraft in a variety of directions and to turn and navigate the watercraft as desired. FIGS. 15–18 illustrate a series of steering scenarios which may be envisaged for driving and turning the watercraft by relative adjustment of rotational speeds and directions of the propulsion units. FIG. 15 represents levels of drive signals applied to the motors of the propulsion units for driving the watercraft first in a forward direction, then in a reverse direction. As shown in FIG. 15, at a time t1, the operator depresses the continuous forward input 124, causing the control circuit to output drive signals which ramp up as indicated by trace 180 to a level corresponding to the speed setting on input 120. While the rate of ramp up or ramp down of the drive signals may be controlled independently, in the embodiment illustrated in FIG. 15, the ramp rate is set, such as in terms of a number of counts per second over the dynamic range of the drive signals. Once the desired speed setting is reached, the drive signal levels off as indicated by trace 182. It should be noted that, where a trim setting has been stored in the memory of the control circuit 142, this trim setting will generally be applied to offset the drive signals applied to the propulsion units accordingly. However, in FIGS. 15–18, the offset is assumed to be zero for the sake of simplicity.

Continuing in FIG. 15, the operator may depress the continuous reverse input 126 at time t2. Depressing the continuous reverse input results in a decline in the drive signal level as indicated by trace 184 until a point is reached at which the speed of the propulsion units is substantially zero, and the motors are reversed. This transition point is indicated at reference numeral 186 in FIG. 15. Thereafter, the speed of the propulsion units is ramped upwardly in amplitude again, but in a reverse direction until a time t3, where the speed set on input 120 is again reached, but in the reverse direction. Trace 188 of FIG. 15 indicates a continuous speed control in the reverse direction. At time t4 in FIG. 15, a zero speed setting is input via the operator control, resulting in a ramp toward a zero drive signal setting at time t5.

The momentary forward and momentary reverse inputs 128 and 130 function in a generally similar manner. That is, when depressed, with the continuous forward or reverse functions operational, selection of the momentary input in the opposite direction results in a relatively rapid ramp downwardly (i.e. toward a zero thrust level) followed by a rapid reversal, so long as the input is held closed. Once the input is released, the drive signals return to their previous directions and levels. If the continuous function is not operational, the motors are turned on (i.e., driven) and their speed is ramped quickly in the momentary input direction.

FIGS. 16 and 17 represent exemplary scenarios for steering the watercraft in one direction, followed by return to a previous setting. As illustrated first in FIG. 16, an initial speed input 192 is provided, causing the propulsion units to drive the watercraft in a straight-ahead direction. At time t1, an operator command is received to steer the watercraft from the initial direction, to the left or to the right. Depending upon the predetermined ramp rate, or upon an operator-set ramp rate, the signals applied to the propulsion units are increased as indicated at reference numeral 194 and decreased as indicated at reference numeral 196. The relative rotational speeds then produce components of thrust which cause the watercraft to steer left or steer right. By way of example, an increase in the rotational speed, and thus the thrust, of the right propulsion unit, accompanied by a decrease in the rotational speed, and thus the thrust, of the left propulsion unit, will cause the watercraft to steer toward the left. Where the steer command is maintained, such as by holding the operator command toe or heel region depressed, the declining drive signal may cross the zero axis, resulting in reversal of the rotational direction of the corresponding motor, as indicated at reference numeral 186 in FIG. 16. In the scenario of FIG. 16, the ramp rate following this reversal continues until the system reaches a maximum turn setting at time t2 (which may correspond to forward and reverse settings different from those shown in FIG. 16). Thereafter, the steering setting will remain constant, until the steering input is removed at time t3. In the scenario illustrated in FIG. 16, a rapid ramp rate is then assumed, as indicated by traces 198, until the straight-ahead settings are obtained at time t4. It will be appreciated, however, that the control input resulting in return to the initial straight-ahead setting could have continued, resulting in steering the watercraft in the opposite direction, by reversal of the relative speed and direction settings of the propulsion units.

In the scenario of FIG. 17, the speed of only one of the propulsion units is adjusted, while the speed of the other propulsion unit remains relatively unchanged. Thus, following an initial setting 192, a command input is received at time t1 to steer the watercraft either to the left or to the right. In the scenario of FIG. 17, such a steer command is followed by a rapid ramp down to a zero speed level, as indicated by trace 200, followed by a more gradual ramp down, as indicated by trace 202. At a time t2, a steering command is received to return to the initial setting, resulting in a rapid ramp up to the initial setting as indicated by trace 206. During the adjustment to the single propulsion unit, as indicated by traces 200, 202 and 206, the remaining propulsion unit was maintained at a fixed speed, as indicated by trace 204.

Steering commands and adjustments of the type described above, may also be made and maintained as indicated in FIG. 18. In the scenario of FIG. 18, drive signals applied to the propulsion units begin at an initial level as indicated by reference numeral 192. At time t1, a steering command is input to navigate the watercraft to the left or to the right. The command results in rapid ramping up of the drive signal to a first of the propulsion units, as indicated by reference numeral 208, and ramping down of the drive signal to the opposite propulsion unit is indicated by trace 210. While both of the drive signals may have maintained the propulsion units rotating in the same direction, in the example of FIG. 18, trace 210 crosses the zero axis, resulting in reversal of the rotational direction of the second propulsion unit. Thereafter, speeds of the propulsion units are maintained at constant levels, as indicated by traces 212. The watercraft is thus rapidly steered to the left or to the right, and maintained at the new steering setting (i.e. left or right turn) until later command inputs are received.

It should be appreciated that the various scenarios for steering presented in FIGS. 15–18 are offered by way of example only. In practice, and with specific propulsion units, props, hull designs, and so forth, optimal ramp rates, maximum drive command levels, and so forth, may be determined. Moreover, as noted above, where the output thrust of the propulsion units is not linearly related to the rotational speed of the motors, adjustments may be made in the levels of the drive signals to provide predictable, repeatable and intuitive steering adjustments based upon the command inputs.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A steering system for a watercraft, the system comprising:

a pair of propulsion units disposed at symmetrical locations with respect to a centerline of the watercraft, each propulsion unit including an electric motor and a prop drivingly coupled to the motor;

a control unit coupled to the electric motors, the control unit being configured to apply drive signals to the electric motors to rotate the props at desired relative speeds to produce components of thrust for steering the watercraft in a desired direction and to change rotational speeds of the motors at predetermined ramp rates in response to operator steering commands.

2. The system of claim 1, wherein the motors are bi-directional motors and the control unit is configured to apply the drive signals to the motors to rotate the props at the desired speeds in clockwise and counterclockwise directions.

3. The system of claim 1, wherein each propulsion unit is disposed to produce a component of thrust directed at an oblique angle with respect to the centerline.

4. The system of claim 3, wherein when the component of thrust produced by each propulsion unit is towards an aft direction, the same component of thrust is directed inwardly toward the centerline.

5. The system of claim 1, wherein the control unit includes an operator input for generating operator steering commands, the drive signals being derived from the operator steering commands.

6. The system of claim 1, wherein the control unit is configured to change the rotational speeds at ramp rates derived from operator steering commands.

7. The system of claim 1, wherein the control unit is configured to change rotational directions of the motors in response to operator steering commands.

8. The system of claim 1, wherein the electric motor of each propulsion unit is disposed inboard of a hull wall and the prop of each propulsion unit is disposed outboard of the hull wall below a waterline.

9. The system of claim 1, wherein each propulsion unit prop is disposed within a recess formed in a hull wall and displaces water through the recess during operation.

10. The system of claim 1, wherein the motors of the propulsion units are switched reluctance motors.

11. The system of claim 1, wherein the control unit is configured to apply drive signals to the propulsion units to maintain at least navigational settings generally parallel to the centerline without operator intervention.

12. A system for steering a watercraft, the system comprising:

first and second electric propulsion units disposed at a stern region, each propulsion unit including an electric motor drivingly coupled to a prop to rotate the prop at desired speeds and in clockwise and counterclockwise directions to produce a desired net thrust for steering the watercraft; and a control unit coupled to the motors of the first and second propulsion units, the control unit being configured to apply drive signals to the motors to rotate the props at the desired speeds and directions to produce the desired net thrust, the control unit being configured to alter the net thrust produced by the props by ramping relative rotation speeds of the motors at desired ramp rates.

13. The system of claim 12, wherein the electric propulsion units are oriented to produce components of the net thrust directed obliquely with respect to a centerline of the watercraft.

14. At The system of claim 13, wherein when the component of thrust produced by each propulsion unit is towards an aft direction, the same component of thrust is directed inwardly toward the centerline.

15. The system of claim 12, further comprising an operator input device for receiving operator steering commands, the control unit applying the drive signals based upon the operator steering commands.

16. The system of claim 12, further comprising an operator input device for receiving operator steering commands, and wherein the desired ramp rates are based upon the operator steering commands.

17. The system of claim 12, wherein the props rotate about fixed rotational axes.

18. The system of claim 12, wherein the electric motor of each propulsion unit is disposed inboard of a hull wall and the prop of each propulsion unit is disposed outboard of the hull wall below a waterline.

19. The system of claim 12, wherein each propulsion unit prop is disposed within a recess formed in a hull wall and displaces water through the recess during operation.

20. The system of claim 12, wherein the motors of the propulsion units are switched reluctance motors.

21. A system for steering a boat, the system comprising:

first and second electric propulsion units mounted at a stern region of the boat, each propulsion unit including a bi directional electric motor and a prop drivingly coupled to the motor, each propulsion unit being disposed in a fixed orientation to produce forwardly and rearwardly directed thrust components; and a control unit coupled to the first and second propulsion units and configured to apply drive signals to the electric motors to rotate the props at desired speeds and directions to produce thrust components for steering the boat and to alter the thrust components produced by the props by ramping relative rotational speeds of the motors at desired ramp rates.

22. The system of claim 21, wherein the thrust components are directed at oblique angles with respect to a centerline of the boat.

23. The system of claim 21, wherein the control unit is configured to rotate the props to produce rearwardly-directed thrust components within a first steering range, and to rotate the props to produce a rearwardly-directed thrust component from the first unit and a forwardly-directed thrust component from the second unit within a second steering range.

24. The system of claim 21, wherein the control unit is configured to drive the motors to produce a net thrust by reducing the rotational speed of the first propulsion unit while maintaining the rotational speed of the second propulsion unit.

25. The system of claim 21, wherein the control unit is configured to drive the motors to produce a net thrust by increasing the rotational speed of the first propulsion unit while maintaining the rotational speed of the second propulsion unit.

26. The system of claim 21, wherein the control unit is configured to drive the motors to produce a net thrust by reducing the rotational speed of the first propulsion unit while increasing the rotational speed of the second propulsion unit.

27. The system of claim 21, wherein the control unit is configured to drive the motors to produce a net thrust by driving the first and second propulsion units in opposite rotational directions.

28. A method for controlling steering of a watercraft, the watercraft having a first and second electric propulsion units disposed at symmetrical locations with respect to a longitudinal centerline of the watercraft, each propulsion unit including an electric motor drivingly coupled to a prop, the method comprising the steps of:

applying first and second drive signals to the first and second propulsion unit motors to drive the respective props at desired speeds, the first and second drive signals being offset from one another by a predetermined trim setting; and regulating the first and second drive signals to coordinate speeds of the first and second propulsion unit props and thereby to generate a desired resultant thrust for navigating the watercraft.

29. The method of claim 28, comprising the further step of receiving an operator steering command signal, wherein the first and second drive signals are based upon the operator steering command signal.

30. The method of claim 28, wherein the first and second drive signals are regulated by increasing the first drive signal and simultaneously decreasing the second drive signal.

31. The method of claim 30, wherein the first and second drive signals are increased and decreased at equal rates.

32. The method of claim 28, wherein the motors are bi-directional motors, and wherein at least one of the first drive signals drives the respective motor in a first rotational direction and the second drive signal drives the respective motor in a second rotational direction opposite the first direction.

33. The method of claim 28, wherein the drive signals are conveyed to the motors via a signal bus.

34. The method of claim 28, wherein the drive signals are applied to the motors to maintain navigational settings generally parallel to the longitudinal centerline without operator intervention.

35. A method for steering a watercraft, the method comprising the steps of:

providing first and second propulsion systems at symmetrical locations with respect to a longitudinal centerline of the watercraft, each propulsion system including a motor drivingly coupled to a prop;

coupling the propulsion systems to a system control circuit;

providing a steering command to the control circuit; and applying drive signals to the first and second propulsion systems from the control circuit to drive the motors and props at relative rotational speeds to produce components of thrust at east of the locations to steer the watercraft in a direction corresponding to the steering command, the drive signals applied to the motors being offset from one another by a predetermined trim setting.

36. The method of claim 35, wherein the propulsion systems are disposed in a stern region of the watercraft.

37. The method of claim 35, wherein, in operation, each of the propulsion systems generates a thrust component generally parallel to a longitudinal centerline of the watercraft and a thrust component generally transverse to the longitudinal centerline.

38. The method of claim 37, wherein the thrust component generally transverse to the longitudinal centerline is oriented at approximately 45 degrees with respect to the centerline.

39. The method of claim 35, wherein each of the motors is bi-directional, and wherein the drive signal applied to the first propulsion system drives the respective motor in a first rotational direction and the drive signal applied to the second propulsion system drives the respective motor in a second rotational direction opposite the first direction.

40. A steering system for a watercraft, the system comprising:

a pair of propulsion units disposed at symmetrical locations with respect to a centerline of the watercraft, each propulsion unit including an electric motor and a prop drivingly coupled to the motor;

a control unit coupled to the electric motors, the control unit being configured to apply drive signals to the electric motors to rotate the props at desired relative speeds to produce components of thrust for steering the watercraft in a desired direction and to change rotational speeds of the motors a predetermined ramp rates derived from operator steering commands.

41. A system for steering a watercraft, the system comprising:

first and second electric propulsion units disposed at a stern region, each propulsion unit including an electric motor drivingly coupled to a prop to rotate the prop at desired speeds and in clockwise and counterclockwise directions to produce a desired net thrust for steering the watercraft; and a control unit coupled to the motors of the first and second propulsion units, the control unit being configured to apply drive signals to the motors to rotate the props at the desired speeds and directions to produce the desired net thrust, and the control unit being configured to alter the net thrust produced by the props by ramping relative rotation speeds of the motors at desired ramp rates; and an operator input device coupled to the control unit, the operator input device configured to receive operator steering commands, wherein the desired ramp rates are based upon the operator steering commands.

* * * * *